US010271692B2

(12) United States Patent
West

(10) Patent No.: US 10,271,692 B2
(45) Date of Patent: Apr. 30, 2019

(54) CLEANING DEVICE

(71) Applicant: Roberto West, Killeen, TX (US)

(72) Inventor: Roberto West, Killeen, TX (US)

( * ) Notice: Subject to any disclaimer, the term of this patent is extended or adjusted under 35 U.S.C. 154(b) by 283 days.

(21) Appl. No.: 15/346,802

(22) Filed: Nov. 9, 2016

(65) Prior Publication Data

US 2018/0126423 A1 May 10, 2018

(51) Int. Cl.

| | |
|---|---|
| ***B08B 1/04*** | (2006.01) |
| ***A47K 3/00*** | (2006.01) |
| ***A47K 3/28*** | (2006.01) |
| ***A47L 13/20*** | (2006.01) |

(52) U.S. Cl.

CPC ..... *A47K 3/281* (2013.01); *A47K 3/001* (2013.01); *A47L 13/20* (2013.01)

(58) Field of Classification Search

CPC ..... B08B 1/04; B08B 1/006; B08B 1/002; B08B 3/04; A47K 3/001; A47K 3/281; A47K 13/20

See application file for complete search history.

(56) References Cited

U.S. PATENT DOCUMENTS

| | | | | |
|---|---|---|---|---|
| 4,399,578 | A | 8/1983 | Bordeaux | |
| D304,630 | S | 11/1989 | Jones et al. | |
| 5,323,506 | A | 6/1994 | Babitch | |
| 5,511,269 | A * | 4/1996 | Watson | A46B 5/0033 15/22.1 |
| 6,199,241 | B1 | 3/2001 | Anumah | |
| 6,742,199 | B2 | 6/2004 | Conway et al. | |
| 8,601,631 | B1 * | 12/2013 | Martin | A46B 13/04 15/29 |
| 9,398,836 | B2 * | 7/2016 | Luedke | A47L 13/225 |
| 9,526,394 | B2 * | 12/2016 | Conrad | A47L 13/225 |
| 10,034,591 | B2 * | 7/2018 | Park | A47L 11/4069 |
| 2005/0066458 | A1 | 3/2005 | Belcastro | |
| 2006/0248666 | A1 * | 11/2006 | Lies | A46B 7/04 15/23 |
| 2006/0260078 | A1 | 11/2006 | Ranks | |
| 2010/0024146 | A1 * | 2/2010 | Rosenzweig | A47L 13/16 15/228 |

* cited by examiner

*Primary Examiner* — Shay Karls

(57) ABSTRACT

A cleaning device for bathtubs and shower enclosures includes a tube. A power module is coupled to an upper end of the tube. A housing that defines an internal space is pivotally coupled to a lower end of the tube. The housing has a bottom face that is open. A plurality of motors is coupled to the housing and is positioned in the internal space. The motors are operationally coupled to the power module. Each of a plurality of pads is operationally couplable to and extends from a respective motor. A lower surface of the pad protrudes from the bottom face of the housing. A reservoir is coupled to the tube and is fluidically coupled to the housing. The pads are configured to rotationally cleanse a surface. The reservoir is configured to selectively release soap and water into the internal space to selectively contact the surface to be cleansed.

18 Claims, 4 Drawing Sheets

CLEANING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning devices and more particularly pertains to a new cleaning device for bathtubs and shower enclosures.

BRIEF SUMMARY OF THE INVENTION

An embodiment of the disclosure meets the needs presented above by generally comprising a tube. A power module is coupled to an upper end of the tube. A housing that defines an internal space is pivotally coupled to a lower end of the tube. The housing has a bottom face that is open. A plurality of motors is coupled to the housing and is positioned in the internal space. The motors are operationally coupled to the power module. Each of a plurality of pads is operationally couplable to and extends from a respective motor. A lower surface of the pad protrudes from the bottom face of the housing. A reservoir is coupled to the tube and is fluidically coupled to the housing. The pads are configured to rotationally cleanse a surface. The reservoir is configured to selectively release soap and water into the internal space to selectively contact the surface to be cleansed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
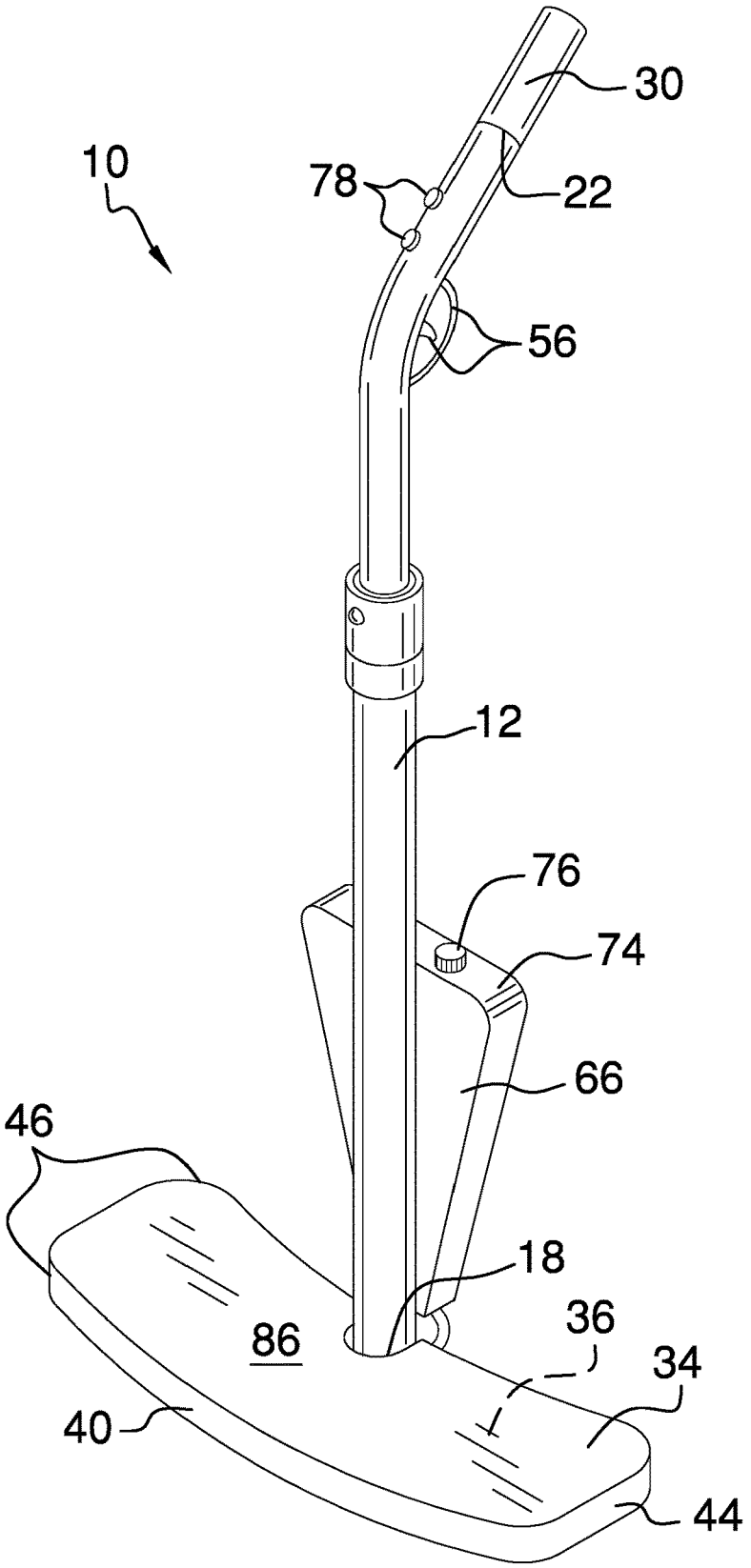
FIG. 1 is an isometric perspective view of a cleaning device according to an embodiment of the disclosure.
Figure 2:
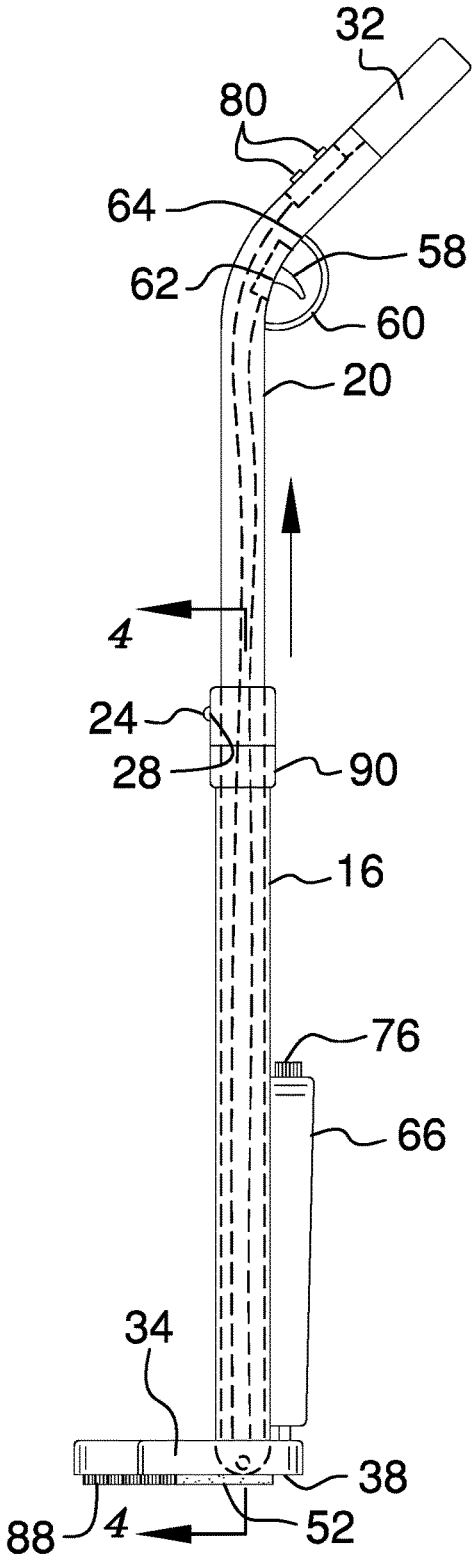
FIG. 2 is a side view of an embodiment of the disclosure.
Figure 3:
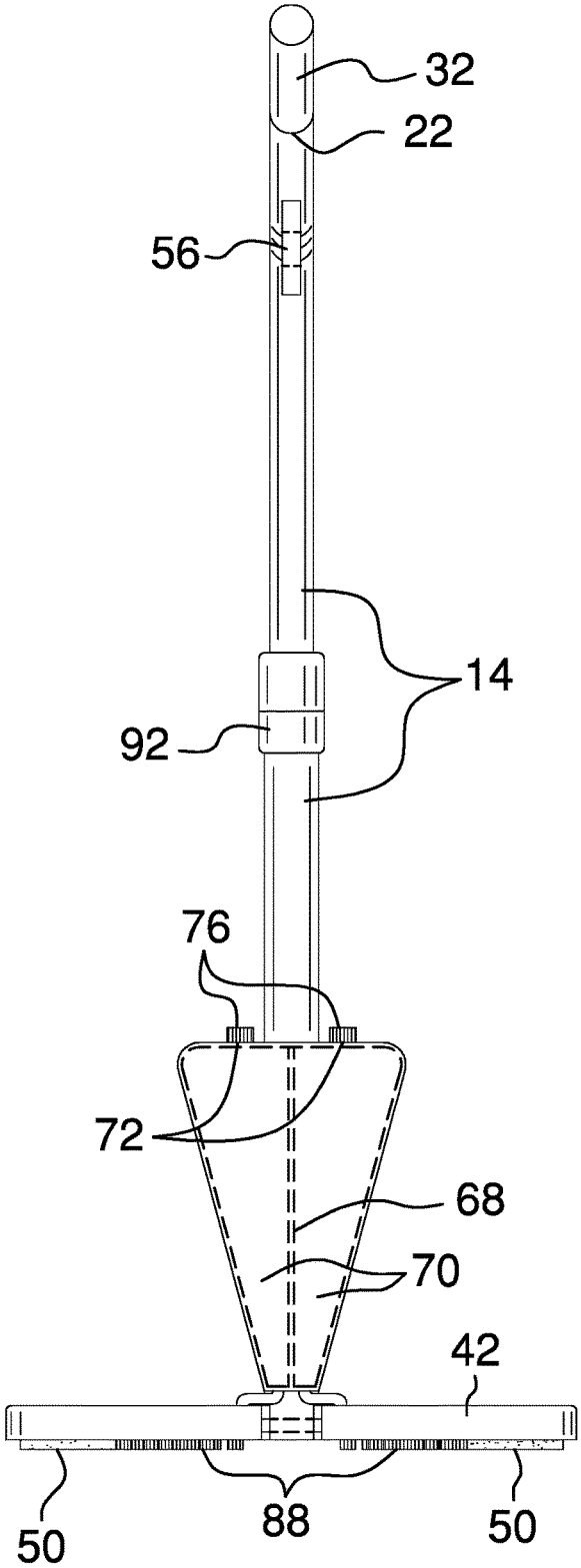
FIG. 3 is a rear view of an embodiment of the disclosure.
Figure 4:
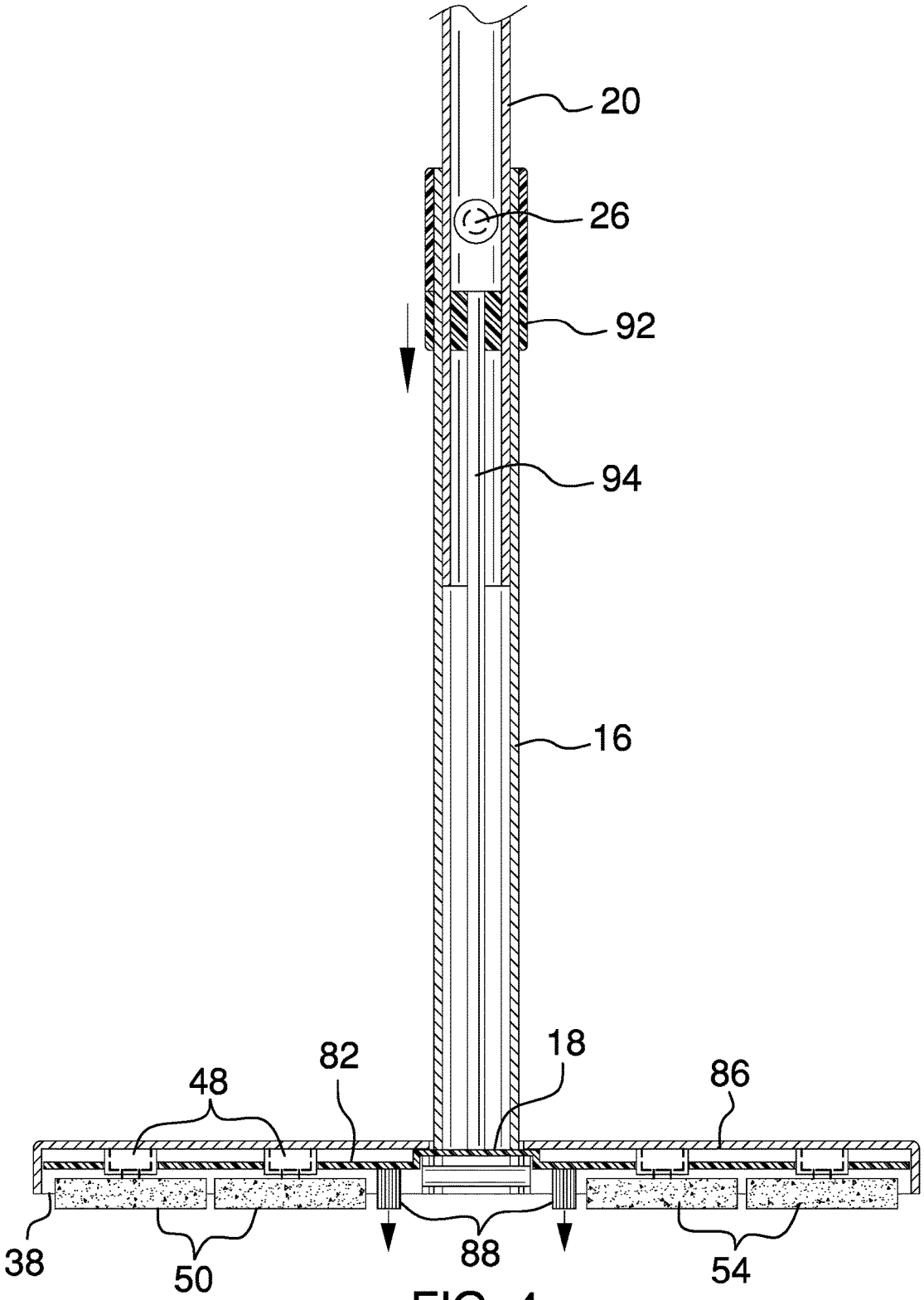
FIG. 4 is a cross-sectional view of an embodiment of the disclosure.
Figure 5:
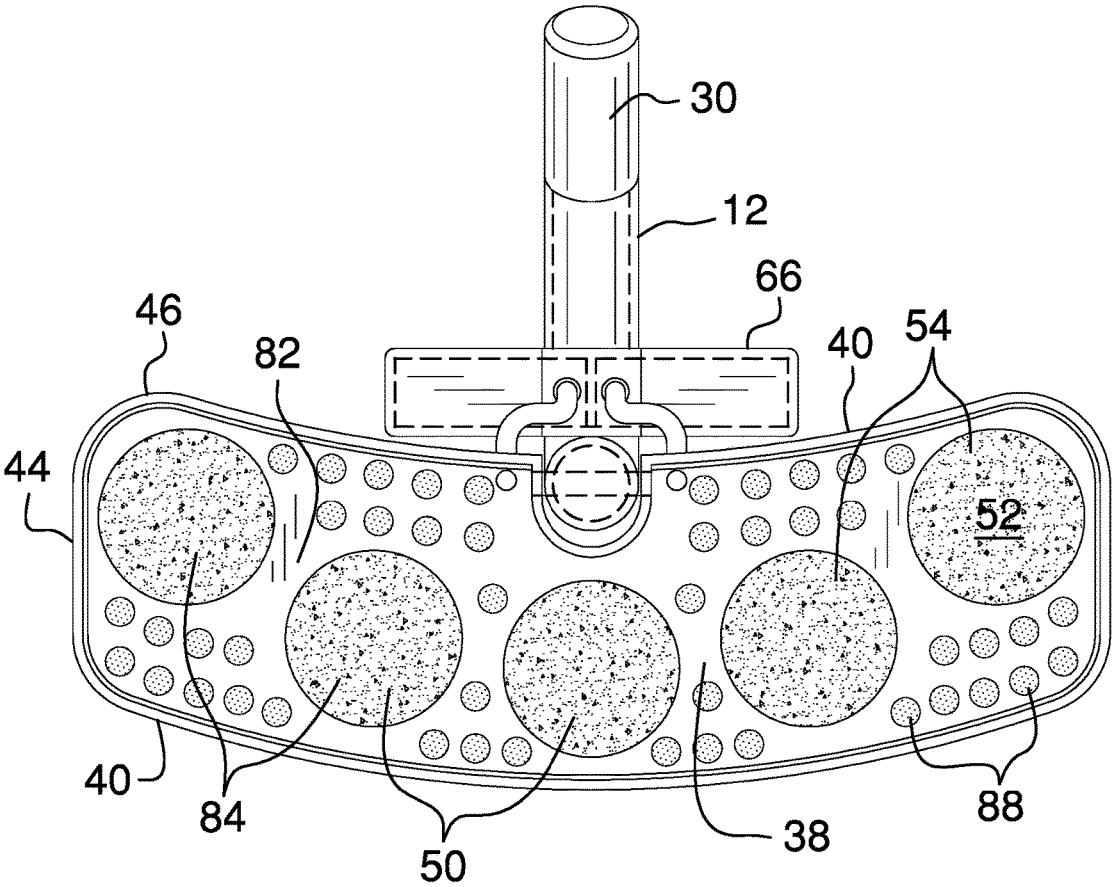
FIG. 5 is a bottom view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the cleaning device 10 generally comprises a tube 12. In one embodiment, the tube 12 comprises a plurality of nested sections 14 such that the tube 12 is selectively extendable. In another embodiment, the plurality of nested sections 14 comprises a linear segment 16 that extends from a lower end 18 of the tube 12 and an angular segment 20 that is extendable from the linear segment 16 to an upper end 22 of the tube 12.

A first coupler 24 is coupled to the angular segment 20. In one embodiment, the first coupler 24 comprises a pin 26 that is spring-loaded. A second coupler 28 is coupled to the linear segment 16. The second coupler 28 is complementary to the first coupler 24. The second coupler 28 is positioned on the linear segment 16 such that the second coupler 28 is positioned to selectively decouple from the first coupler 24 so that the tube 12 is extendable.

A power module 30 is coupled to the upper end 22 of the tube 12. In one embodiment, the power module 30 comprises at least one battery 32. In another embodiment, the at least one battery 32 is rechargeable. In yet another embodiment, the power module 30 is screwedly couplable to the tube 12.

A housing 34 that defines an internal space 36 is pivotally coupled to the lower end 18 of the tube 12. The housing 34 has a bottom face 38 that is open. The housing 34 has a front face 40 and a back face 42. In one embodiment, the front face 40 is convexly shaped and the back face 42 is concavely shaped. The front face 40, the back face 42 and opposing side faces 44 of the housing 34 and define edges 46. In another embodiment, the edges 46 are rounded.

A plurality of motors 48 is coupled to the housing 34 and is positioned in the internal space 36. The motors 48 are operationally coupled to the power module 30. In one embodiment, the plurality of motors 48 comprises five motors 48.

Each of a plurality of pads 50 is operationally couplable to and extends from a respective motor 48. A lower surface 52 of the pad 50 protrudes from the bottom face 38 of the housing 34. The pads 50 are positioned on the motors 48 such that the pads 50 are configured to rotationally cleanse a surface. The pads 50 are abrasive. In one embodiment, the pads 50 comprise sponge. In another embodiment, the pads 50 comprise brushes 54.

A switch 56 is coupled to the tube 12 proximate to the upper end 22. The switch 56 is operationally coupled to the power module 30 and the plurality of motors 48. The switch 56 is positioned on the tube 12 such that the switch 56 is configured to selectively couple the motors 48 to the power module 30. In one embodiment, the switch 56 comprises a trigger 58 and a guard 60. The trigger 58 extends through a slot 62 that is positioned in the tube 12. The guard 60 is arcuate and has opposing ends 64. The opposing ends 64 are coupled to the housing 34 proximate to the slot 62.

A reservoir 66 is coupled to the tube 12. The reservoir 66 is fluidically coupled to the housing 34. The reservoir 66 is configured to selectively infuse soap and water into the internal space 36. The reservoir 66 is positioned on the tube 12 such that the reservoir 66 is configured to selectively release soap and water into the internal space 36 such that the soap and water are selectively contacted with the surface to be cleansed.

In one embodiment, a partition 68 is coupled to and is positioned in the reservoir 66 and defines a pair of chambers 70. Each of a pair of orifices 72 is positioned through a top wall 74 of the reservoir 66. Each orifice 72 is fluidically coupled to a respective chamber 70. The orifices 72 are positioned in the top wall 74 such that the orifices 72 are configured to allow selective addition of soap and water into the chambers 70. Each of a pair of caps 76 is reversibly couplable to the top wall 74. The caps 76 are positioned to reversibly couple to the top wall 74 to open and close the orifices 72.

A control module 78 is coupled to the tube 12 proximate to the upper end 22. The control module 78 is operationally coupled to the reservoir 66. The control module 78 is positioned on the tube 12 such that the control module 78 is positioned to selectively motivate the reservoir 66 to release soap and water into the internal space 36. In one embodiment, the control module 78 comprises a pair of buttons 80. The buttons 80 are depressible. Each button 80 is operationally coupled to a respective chamber 70.

A plate 82 that is complementary to the bottom face 38 of the housing 34 is selectively positionable within the internal space 36. A plurality of penetrations 84 is positioned through the plate 82. Each penetration 84 is aligned with a respective pad 50 so that the plate 82 is positionable proximate to an upper face 86 of the housing 34.

A plurality of bristles 88 is coupled to and extends from the plate 82. The bristles 88 are positioned on the plate 82 such that the bristles 88 protrude past the pads 50 when the plate 82 is selectively positioned distal from the upper face 86 of the housing 34.

A controller 90 is coupled to the tube 12. The controller 90 is operationally coupled to the plate 82. The controller 90 is positioned on the tube 12 such that the controller 90 is positioned to selectively motivate the plate 82 from a position proximate to the upper face 86 to a position distal from the upper face 86. The bristles 88 are selectively positionable relative to the pads 50.

In one embodiment, the controller 90 comprises a ring 92 and a rod 94. The ring 92 is selectively longitudinally positionable around the tube 12. The rod 94 is coupled to and extends substantially perpendicularly from the plate 82 such that the rod 94 is longitudinally positioned within the tube 12. The rod 94 is operationally coupled to the ring 92. The ring 92 is positioned on the tube 12 such that the ring 92 is positioned to selectively motivate the rod 94 to compel the plate 82 from a position proximate to the upper face 86 to a position distal from the upper face 86. The bristles 88 are selectively positionable relative to the pads 50.

The present invention also anticipates the tube 12 and the housing 34 being coupled to a swivel ball joint. The tube 12 would be variably pivotable relative to the front face 40 and the back face 42 of the housing 34. The tube 12 also would be variably pivotable relative to the opposing side faces 44 of the housing 34.

In use, the second coupler 28 is positioned to selectively decouple from the first coupler 24 so that the tube 12 is extendable. The caps 76 are positioned to reversibly couple to the top wall 74 to open and close the orifices 72. The orifices 72 are configured to allow selective addition of soap and water into the chambers 70. The switch 56 is configured to selectively couple the motors 48 to the power module 30. The pads 50 are configured to rotationally cleanse the surface. The controller 90 is positioned to selectively motivate the plate 82 from a position proximate to the upper face 86 to a position distal from the upper face 86. The bristles 88 are selectively positionable relative to the pads 50. The control module 78 is positioned to selectively motivate the reservoir 66 to release soap and water into the internal space 36 to selectively contact the surface to be cleansed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cleaning device comprising:

a tube;

a power module coupled to an upper end of said tube;

a housing defining an internal space, said housing being pivotally coupled to a lower end of said tube, said housing having a bottom face, said bottom face being open;

a plurality of motors coupled to said housing and positioned in said internal space, said motors being operationally coupled to said power module;

a plurality of pads, each said pad being operationally couplable to and extending from a respective said motor such that a lower surface of said pad protrudes from said bottom face of said housing;

a reservoir coupled to said tube, said reservoir being fluidically coupled to said housing, said reservoir being configured for selective infusion of soap and water into said internal space;

wherein said pads are positioned on said motors such that said pads are configured for rotational cleansing of a surface, wherein said reservoir is positioned on said tube such that said reservoir is configured for selectively releasing soap and water into said internal space such that the soap and water are selectively contacted with the surface to be cleansed;

a plate complementary to said bottom face of said housing, said plate being selectively positionable within said internal space;

a plurality of penetrations positioned through said plate, each said penetration being aligned with a respective said pad such that said plate is positionable proximate to an upper face of said housing;

a plurality of bristles coupled to and extending from said plate;

a controller coupled to said tube, said controller being operationally coupled to said plate; and wherein said bristles are positioned on said plate such that said bristles protrude past said pads when said plate is selectively positioned distal from said upper face of said housing, wherein said controller is positioned on said tube such that said controller is positioned to selectively motivate said plate from a position proximate to said upper face to a position distal from said upper face such that said bristles are selectively positionable relative to said pad.

2. The device of claim 1, further including said tube comprising a plurality of nested sections such that said tube is selectively extendable.

3. The device of claim 2, further including said plurality of nested sections comprising a linear segment extending from a lower end of said tube and an angular segment extendable from said linear segment to an upper end of said tube.

4. The device of claim 3, further comprising:

a first coupler coupled to said angular segment;

a second coupler coupled to said linear segment, said second coupler being complementary to said first coupler; and wherein said second coupler is positioned on said linear segment such that said second coupler is positioned to selectively decouple from said first coupler such that said tube is extendable.

5. The device of claim 4, further including said first coupler comprising a pin, said pin being spring-loaded.

6. The device of claim 1, further including said power module comprising at least one battery.

7. The device of claim 6, further including said at least one battery being rechargeable.

8. The device of claim 1, further including said power module being screwedly couplable to said tube.

9. The device of claim 1, further including said housing having a front face and a back face, said front face being convexly shaped, said back face being concavely shaped.

10. The device of claim 9, further including said front face, said back face and opposing side faces of said housing defining edges, said edges being rounded.

11. The device of claim 1, further including said plurality of motors comprising five said motors.

12. The device of claim 1, further including said pads being abrasive.

13. The device of claim 12, further including said pads comprising sponge.

14. The device of claim 12, further including said pads comprising brushes.

15. The device of claim 1, further including said controller comprising a ring and a rod, said ring being selectively longitudinally positionable around said tube, said rod being coupled to and extending substantially perpendicularly from said plate such that said rod is longitudinally positioned within said tube, said rod being operationally coupled to said ring, wherein said ring is positioned on said tube such that said ring is positioned to selectively motivate said rod to compel said plate from a position proximate to said upper face to a position distal from said upper face such that said bristles are selectively positionable relative to said pads.

16. The device of claim 1, further comprising:

a partition coupled to and positioned in said reservoir defining a pair of chambers;

a pair of orifices positioned through a top wall of said reservoir, each said orifice being fluidically coupled to a respective said chamber;

a pair of caps, each said cap being reversibly couplable to said top wall;

a switch coupled to said tube proximate to said upper end, said switch being operationally coupled to said power module and said plurality of motors;

a control module coupled to said tube proximate to said upper end, said control module being operationally coupled to said reservoir; and wherein said orifices are positioned in said top wall such that said orifices are configured for selective addition of soap and water into said chambers, wherein said caps are positioned to reversibly couple to said top wall to open and close said orifices, wherein said switch is positioned on said tube such that said switch is configured for selectively coupling said motors to said power module, wherein said control module is positioned on said tube such that said control module is positioned to selectively motivate said reservoir to release soap and water into said internal space.

17. The device of claim 16, further comprising:

said switch comprising a trigger and a guard, said trigger extending through a slot positioned in said tube, said guard having opposing ends, said guard being arcuate, said opposing ends being coupled to said housing proximate to said slot; and said control module comprising a pair of buttons, said buttons being depressible, each said button being operationally coupled to a respective said chamber.

18. A cleaning device comprising:

a tube, said tube comprising a plurality of nested sections such that said tube is selectively extendable, said plurality of nested sections comprising a linear segment extending from a lower end of said tube and an angular segment extendable from said linear segment to an upper end of said tube;

a first coupler coupled to said angular segment, said first coupler comprising a pin, said pin being spring-loaded;

a second coupler coupled to said linear segment, said second coupler being complementary to said first coupler, wherein said second coupler is positioned on said linear segment such that said second coupler is positioned to selectively decouple from said first coupler such that said tube is extendable;

a power module coupled to said upper end of said tube, said power module comprising at least one battery, said at least one battery being rechargeable, said power module being screwedly couplable to said tube;

a housing defining an internal space, said housing being pivotally coupled to said lower end of said tube, said housing having a bottom face, said bottom face being open, said housing having a front face and a back face, said front face being convexly shaped, said back face being concavely shaped, said front face, said back face and opposing side faces of said housing defining edges, said edges being rounded;

a plurality of motors coupled to said housing and positioned in said internal space, said motors being operationally coupled to said power module, said plurality of motors comprising five said motors;

a plurality of pads, each said pad being operationally couplable to and extending from a respective said motor such that a lower surface of said pad protrudes from said bottom face of said housing, wherein said pads are positioned on said motors such that said pads are configured for rotational cleansing of a surface, said pads being abrasive, said pads comprising sponge, said pads comprising brushes;

a reservoir coupled to said tube, said reservoir being fluidically coupled to said housing, said reservoir being configured for selective infusion of soap and water into said internal space, wherein said reservoir is positioned on said tube such that said reservoir is configured for selectively releasing soap and water into said internal space such that the soap and water are selectively contacted with the surface to be cleansed;

a plate complementary to said bottom face of said housing, said plate being selectively positionable within said internal space;

a plurality of penetrations positioned through said plate, each said penetration being aligned with a respective said pad such that said plate is positionable proximate to an upper face of said housing;

a plurality of bristles coupled to and extending from said plate, wherein said bristles are positioned on said plate such that said bristles protrude past said pads when said plate is selectively positioned distal from said upper face of said housing;

a controller coupled to said tube, said controller being operationally coupled to said plate, wherein said controller is positioned on said tube such that said controller is positioned to selectively motivate said plate from a position proximate to said upper face to a position distal from said upper face such that said bristles are selectively positionable relative to said pads, said controller comprising a ring and a rod, said ring being selectively longitudinally positionable around said tube, said rod being coupled to and extending substantially perpendicularly from said plate such that said rod is longitudinally positioned within said tube, said rod being operationally coupled to said ring, wherein said ring is positioned on said tube such that said ring is positioned to selectively motivate said rod to compel said plate from a position proximate to said upper face to a position distal from said upper face such that said bristles are selectively positionable relative to said pads;

a partition coupled to and positioned in said reservoir defining a pair of chambers;

a pair of orifices positioned through a top wall of said reservoir, each said orifice being fluidically coupled to a respective said chamber, wherein said orifices are positioned in said top wall such that said orifices are configured for selective addition of soap and water into said chambers;

a pair of caps, each said cap being reversibly couplable to said top wall, wherein said caps are positioned to reversibly couple to said top wall to open and close said orifices;

a switch coupled to said tube proximate to said upper end, said switch being operationally coupled to said power module and said plurality of motors, wherein said switch is positioned on said tube such that said switch is configured for selectively coupling said motors to said power module, said switch comprising a trigger and a guard, said trigger extending through a slot positioned in said tube, said guard having opposing ends, said guard being arcuate, said opposing ends being coupled to said housing proximate to said slot;

a control module coupled to said tube proximate to said upper end, said control module being operationally coupled to said reservoir, wherein said control module is positioned on said tube such that said control module is positioned to selectively motivate said reservoir to release soap and water into said internal space, said control module comprising a pair of buttons, said buttons being depressible, each said button being operationally coupled to a respective said chamber; and wherein said second coupler is positioned on said linear segment such that said second coupler is positioned to selectively decouple from said first coupler such that said tube is extendable, wherein said caps are positioned to reversibly couple to said top wall to open and close said orifices, wherein said orifices are positioned in said top wall such that said orifices are configured for selective addition of soap and water into said chambers, wherein said switch is positioned on said tube such that said switch is configured for selectively coupling said motors to said power module wherein said pads are positioned on said motors such that said pads are configured for rotational cleansing of a surface, wherein said controller is positioned on said tube such that said controller is positioned to selectively motivate said plate from a position proximate to said upper face to a position distal from said upper face such that said bristles are selectively positionable relative to said pads, wherein said control module is positioned on said tube such that said control module is positioned to selectively motivate said reservoir to release soap and water into said internal space such that the soap and water are selectively contacted with the surface to be cleansed.

* * * * *